US008449105B2

(12) United States Patent
Kanazawa

(10) Patent No.: US 8,449,105 B2
(45) Date of Patent: May 28, 2013

(54) PRINTING APPARATUS AND METHOD OF INSTALLING PRINTING APPARATUS

(75) Inventor: Manabu Kanazawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 164 days.

(21) Appl. No.: 12/949,702

(22) Filed: Nov. 18, 2010

(65) Prior Publication Data

US 2011/0273522 A1 Nov. 10, 2011

(30) Foreign Application Priority Data

May 10, 2010 (JP) ..... 2010-108788

(51) Int. Cl.
*B41J 2/01* (2006.01)
*B41J 29/13* (2006.01)
*B41J 29/393* (2006.01)
*B41J 29/38* (2006.01)

(52) U.S. Cl.
USPC ..... 347/104; 347/108; 347/16; 347/19

(58) Field of Classification Search
None
See application file for complete search history.

(56) References Cited

U.S. PATENT DOCUMENTS 3,152,801 A * 10/1964 Quinn et al. ..... 271/9.11
4,674,866 A * 6/1987 Tanaka ..... 355/23
5,374,972 A * 12/1994 Nakane et al. ..... 396/613
6,393,764 B1 * 5/2002 Smith ..... 47/65.5
6,473,152 B1 * 10/2002 Yokota ..... 355/30
6,536,863 B1 * 3/2003 Beauchamp et al. ..... 347/17
6,664,993 B2 * 12/2003 Isono ..... 347/213
6,725,770 B2 * 4/2004 Maeda ..... 101/129
7,063,416 B2 * 6/2006 Laaspere et al. ..... 347/104
7,591,463 B2 * 9/2009 An ..... 271/160
7,942,488 B2 * 5/2011 Lang ..... 347/7
8,157,367 B2 * 4/2012 Matsuhashi ..... 347/101
2004/0252354 A1 * 12/2004 Shimizu ..... 358/496
2005/0162496 A1 * 7/2005 Elenes ..... 347/108
2005/0184443 A1 * 8/2005 Satoh et al. ..... 271/10.01
2007/0081064 A1 * 4/2007 Spencer et al. ..... 347/104
2007/0081067 A1 * 4/2007 Omori et al. ..... 347/108
2007/0120934 A1 * 5/2007 Lang ..... 347/104
2008/0224386 A1 * 9/2008 Kunieda et al. ..... 271/226
2008/0240837 A1 * 10/2008 Green ..... 400/693
2009/0033733 A1 * 2/2009 Higashimoto et al. ..... 347/104
2010/0320672 A1 * 12/2010 Fukasawa et al. ..... 270/20.1
2011/0273522 A1 * 11/2011 Kanazawa ..... 347/102

FOREIGN PATENT DOCUMENTS

JP 2006-259675 A 9/2006
JP 2008-126530 A 6/2008

* cited by examiner

*Primary Examiner* — Stephen Meier
*Assistant Examiner* — Leonard S Liang
(74) *Attorney, Agent, or Firm* — Canon USA, Inc., IP Division

(57) ABSTRACT

A printing apparatus includes a first housing at least a sheet feeding unit is provided therein and a second housing at least a printing unit is provided therein. The first housing and the second housing are individually supported on a floor. The first housing and the second housing are separable for the purpose of maintenance.

13 Claims, 6 Drawing Sheets

PRINTING APPARATUS AND METHOD OF INSTALLING PRINTING APPARATUS

BACKGROUND OF THE INVENTION

1. Field of the Invention

The present invention relates to a printing apparatus that performs printing on a continuous sheet.

2. Description of the Related Art

Japanese Patent Laid-Open No. 2008-126530 discloses a printing apparatus that performs inkjet duplex printing, i.e., printing on both front and back sides, on a rolled sheet, i.e., a long sheet that is wound in a roll.

The apparatus disclosed in Japanese Patent Laid-Open No. 2008-126530 includes two roll holders. While back-side printing is being performed in duplex printing, another rolled sheet can be loaded. Thus, quick transition to printing on the subsequent rolled sheet is realized.

A rolled sheet used in bulk printing weighs as heavy as about five kilograms to several tens of kilograms. When such a heavy rolled sheet is loaded, a large vibration (impact) is applied to the printing apparatus. If a print engine unit and a sheet feeding unit are provided in one housing as in the apparatus disclosed in Japanese Patent Laid-Open No. 2008-126530, a large vibration occurring when a rolled sheet is loaded during printing is transmitted to the print engine unit, and the print quality may be deteriorated. Particularly, inkjet print heads perform printing on the basis of highly accurate positioning. Therefore, if any external vibration is transmitted to such a print head during printing, ink droplets may land at deviated positions on the sheet, and the print quality may be deteriorated.

SUMMARY OF THE INVENTION

In light of the above, the present invention provides a printing apparatus in which high-quality printing is realized by suppressing the transmission of any vibration to a printing unit occurring when a continuous sheet, such as a rolled sheet, is loaded, and in which maintenance operations, such as recovery from a jam and replacement of parts, are performed easily.

According to a first aspect of the present invention, a printing apparatus includes a sheet feeding unit configured to feed a continuous sheet, a printing unit configured to perform printing on the continuous sheet fed from the sheet feeding unit, a first housing at least the sheet feeding unit is provided therein, and a second housing at least the printing unit is provided therein. The first housing and the second housing are individually supported on a floor and are separable.

In the printing apparatus according to the first aspect of the present invention, since the sheet feeding unit and the printing unit are provided in separate housings, i.e., the first housing and the second housing, respectively, the transmission of any vibration to the printing unit occurring when a sheet is loaded into the sheet feeding unit is suppressed. Thus, high-quality printing is realized. Furthermore, a sheet to be used subsequently is loadable into the sheet feeding unit even during printing. Therefore, the total print throughput is increased, and a highly productive printing apparatus is realized. In addition, the first housing and the second housing are separable, producing a space therebetween. The space allows the user to easily perform maintenance operations such as recovery from a jam and replacement of parts.

On the other hand, if the floor of a user's operating environment on which a printing apparatus is to be installed is not flat, the housing of the apparatus may be distorted, and the relative positional relationship among individual units provided in the housing may change. Consequently, the print quality may be deteriorated. Particularly, inkjet print heads perform printing on the basis of highly accurate positioning. Therefore, if such a printing unit is distorted, ink droplets may land at deviated positions on the sheet, and the print quality may be deteriorated.

In light of the above, the present invention provides a method of installing a printing apparatus in which the relative positional relationship among units provided in a housing does not change even if a floor on which the printing apparatus is to be installed is not flat.

According to a second aspect of the present invention, a method of installing a printing apparatus includes preparing a base having a reference installation surface; placing a housing on the reference installation surface with a plurality of support legs interposed therebetween, the support legs having adjusters, respectively, capable of height adjustment; adjusting the adjusters such that a level placed on a reference surface defined in the housing placed on the reference installation surface shows a specific reading; assembling the printing apparatus by putting a plurality of units including a printing unit into the housing; installing the printing apparatus in an assembled state on a floor of an operating environment; and adjusting the adjusters such that the level placed on the reference surface defined in the housing of the printing apparatus installed on the floor of the operating environment shows the specific reading.

By the method according to the second aspect of the present invention, the relative positional relationship among the units provided in the housing does not change even if the floor on which the printing apparatus is to be installed is not flat. Therefore, high-quality printing is realized.

Further features of the present invention will become apparent from the following description of exemplary embodiments with reference to the attached drawings.

DESCRIPTION OF THE EMBODIMENTS

An embodiment of the present invention concerning a printing apparatus employing an inkjet method will now be described. The printing apparatus according to the embodiment is a high-speed line printer performing printing on a long continuous sheet and capable of both simplex and duplex printing. The continuous sheet has a length larger than that of each of print units that are repeatedly provided in a conveyance direction. A single print unit is also referred to as a page or a unit image. The printing apparatus is suitable for bulk printing performed in, for example, printing laboratories. In this specification, a print unit (a page) may include a mixture of small images, characters, and/or blanks. Such a mixture included in a single print unit is regarded as a single unit image. That is, a unit image refers to each of print units (pages) that are sequentially printed on a continuous sheet. The unit image is also simply referred to as an image. The length of the unit image varies with the size of an image to be printed. For example, large (L)-size photographs have a length of 135 mm in the conveyance direction, and A4-size sheets have a length of 297 mm in the conveyance direction.

The present invention is applicable to a wide variety of printing apparatuses such as a printer, a multifunctional printer, a copier, a facsimile, and other apparatuses for manufacturing various devices in which ink is used and the ink needs to be dried. The present invention is also applicable to printing apparatuses that perform printing by a liquid development method in which a latent image is formed with a laser or the like on a sheet to which a photosensitive material is applied, and to sheet processing apparatuses that perform various processing operations (recording, treatment, coating, radiation, reading, inspection, and so forth) other than the printing operation and in which a continuous sheet needs to be dried.

Figure 1:
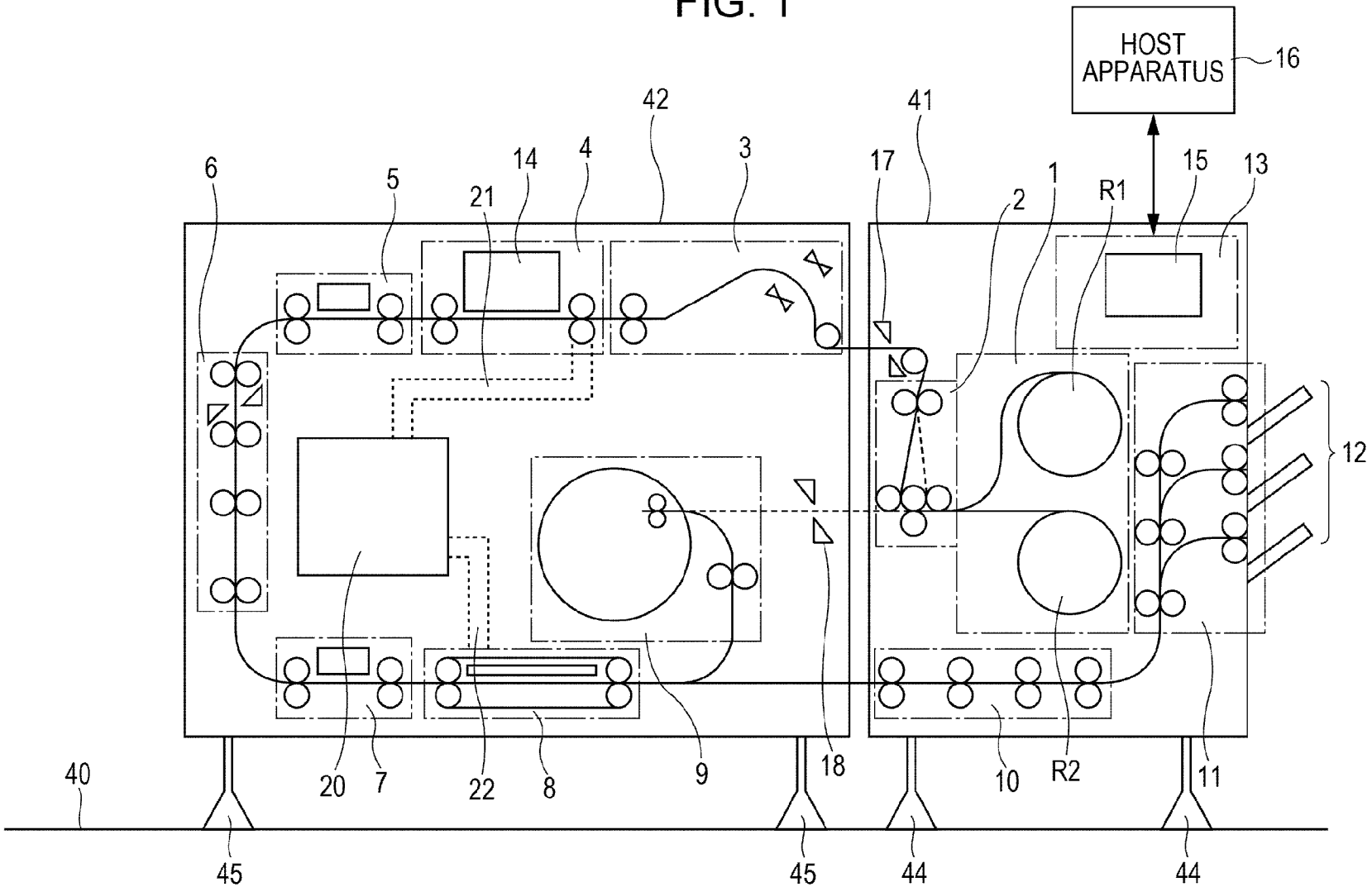
FIG. 1 is a schematic diagram showing the internal configuration of the entirety of a printing apparatus.

FIG. 1 is a schematic cross-sectional view showing the internal configuration of the entirety of a printing apparatus according to the embodiment. The printing apparatus is capable of performing duplex printing on a sheet that is wound in a roll, i.e., printing on first and second surfaces of the sheet, the second surface being opposite the first surface.

The printing apparatus includes two bodies: a first housing 41 and a second housing 42. The first housing 41 and the second housing 42 are individually supported on a floor 40. The second housing 42 houses a printing unit 4, an inspecting unit 5, a cutter unit 6, a drying unit 8, a reverse unit 9, and a humidifying unit 20. The first housing 41 houses a sheet feeding unit 1, a decurling unit 2, a discharge-conveyance unit 10, a sorting unit 11, a discharge unit 12, and a control unit 13. The first housing 41 stands on the floor 40 with four support legs 44 provided at the four corners of the bottom face thereof. The second housing 42 stands on the floor 40 with four support legs 45 provided at the four corners of the bottom face thereof. The support legs 44 are provided with casters, respectively, whereby the first housing 41 is movable on the floor 40. The first housing 41 and the casters are separable. The support legs 45 are provided with adjusters, respectively, for height adjustment, whereby the distance between the floor 40 and the bottom face of the second housing 42 is adjustable at the individual corners. The sheet is conveyed along a conveyance path, shown by the solid line in FIG. 1, by conveying mechanisms including pairs of rollers and belts, and is subjected to various processing operations performed by the above-mentioned units. With respect to any position in the conveyance path, the side near the sheet feeding unit 1 is referred to as "the upstream side," and the opposite side is referred to as "the downstream side."

The sheet feeding unit 1 holds a continuous sheet that is wound in a roll (a rolled sheet) and feeds the sheet. The sheet feeding unit 1 can house two rolls R1 and R2, from either of which the sheet is unwound to be fed. The number of rolls that can be housed in the sheet feeding unit 1 is not limited to two. The sheet feeding unit 1 may house only a single roll, or three or more rolls. Moreover, the sheet is not limited to a rolled sheet, as long as it is continuous. For example, the sheet may be a continuous sheet that is perforated by unit lengths and is alternately folded at the perforations so as to be housed in the sheet feeding unit 1.

The decurling unit 2 reduces a curl of the sheet fed from the sheet feeding unit 1. The decurling unit 2 includes one driving roller and two pinch rollers. A decurling force is made to act on the sheet by causing the sheet to pass through the rollers in such a manner as to be bent in the direction opposite to the direction of the curl thereof, whereby the curl is reduced.

A skew correcting unit 3 corrects any skew of the sheet (an obliquity with respect to the original direction in which the sheet advances) that has passed through the decurling unit 2. The skew correcting unit 3 forms a loop (a curve) in the sheet that is being conveyed and presses a reference side end of the sheet against a guide member, whereby the skew of the sheet is corrected. The skew correcting unit 3 is not limited to be housed in the second housing 42 in the entirety thereof, and part thereof or the entirety thereof may be in the first housing 41.

The printing unit 4 performs printing with a plurality of print heads 14 from above on the sheet that is being conveyed, thereby forming an image on the sheet. The printing unit 4 also includes a plurality of conveying rollers that convey the sheet. The print heads 14 are line print heads each having rows of inkjet nozzles provided in such a manner as to cover the width of the largest sheet among various sheets to be used. The print heads 14 are arranged parallel to each other and side by side in the conveyance direction. In the embodiment, seven print heads 14 for seven colors of cyan (C), magenta (M), yellow (Y), light cyan (LC), light magenta (LM), gray (G), and black (K) are provided. The numbers of colors and print heads 14 are each not limited to seven. Moreover, any of various inkjet methods may be employed, such as those employing heater devices, piezo devices, electrostatic devices, micro-electro-mechanical systems (MEMS), and the like. Inks for the foregoing colors are supplied from ink tanks to the print heads 14 through ink tubes.

The inspecting unit 5 includes a scanner with which an inspection pattern and/or an image printed on the sheet by the printing unit 4 is optically read, and inspects the condition of the nozzles of the print heads 14, the state of conveyance, the image position, and so forth, thereby determining whether or not an image has been printed correctly. The scanner includes a charge-coupled-device (CCD) image sensor, a complementary-metal-oxide-semiconductor (CMOS) image sensor, or the like.

The cutter unit 6 includes a mechanical cutter that cuts the sheet that has undergone printing into pieces of specific lengths. The cutter unit 6 also includes a plurality of conveying rollers that convey the cut pieces of the sheet toward the downstream side.

An information recording unit 7 records printing information (unique information), such as the serial number and the date, on a non-printed area of each cut sheet. The recording is performed by printing characters, codes, and/or the like by an inkjet method, a thermal transfer method, or the like.

The drying unit 8 heats the sheet that has undergone printing performed by the printing section 4, thereby quickly drying the ink on the sheet. The sheet passes through the drying unit 8 with the printed side thereof, which has ink and is to be dried, facing downward (facing the floor 40). In the drying unit 8, hot air is fed to the sheet that is being conveyed at least from below the sheet, whereby the side of the sheet having ink is dried. The drying method employed by the drying unit 8 is not limited to the method in which hot air is used and may be any of other methods, such as a method in which electromagnetic waves (ultraviolet rays, infrared rays, or the like) are applied to the surface of the sheet.

A conveyance path extending from the sheet feeding unit 1 to the drying unit 8 is referred to as a first path. The first path extends such that the path makes a U-turn in a portion thereof from the printing unit 4 to the drying unit 8. The cutter unit 6 is provided at a position in the U-turn.

In duplex printing, the reverse unit 9 temporarily winds up the continuous sheet that has undergone front-side printing and reverses the front and back sides of the sheet. The reverse unit 9 is provided at a position in a path (a loop path, also referred to as a second path) extending from the drying unit 8 via the decurling unit 2 to the printing unit 4. The second path is intended for refeeding the sheet that has passed through the drying unit 8 to the printing unit 4. The reverse unit 9 includes a rotatable winding rotary member around which the sheet is wound. The continuous sheet that has undergone front-side printing but is yet to be cut is temporarily wound around the winding rotary member. When the entirety of the sheet has been wound up, the winding rotary member rotates in the reverse direction, whereby the wound sheet is unwound in the direction opposite to that in which the sheet has been wound and is fed to the decurling unit 2 and then to the printing unit 4. Since the sheet in this state has the front and back sides thereof reversed, the printing unit 4 can perform printing on the back side of the sheet.

The discharge-conveyance section 10 conveys each cut sheet obtained by the cutter unit 6 and dried by the drying unit 8, and delivers the sheet to the sorting unit 11. The discharge-conveyance unit 10 is provided on a path (referred to as a third path) different from the second path on which the reverse unit 9 is provided. To selectively guide the sheet that has been conveyed from the first path to either of the second and third paths, a path switching mechanism including a movable flapper is provided at the point where the first path branches into the second and third paths.

The sorting unit 11 and the discharge unit 12 are provided on a lateral side with respect to the sheet feeding unit 1 and at the end of the third path. The sorting unit 11 sorts printed sheets according to need. The sorted sheets are discharged to the discharge unit 12 including a plurality of trays. Thus, the third path runs below the sheet feeding unit 1 and extends in such a manner as to discharge the sheet toward a side across the sheet feeding unit 1 from the printing unit 4 and the drying unit 8.

As described above, the units including the sheet feeding unit 1 to the drying unit 8 are provided in that order on the first path. The first path branches into the second and third paths at a point thereof on the downstream side with respect to the drying unit 8. The second path is provided with the reverse unit 9 at a halfway position thereof, and joins the first path at a point thereof on the downstream side with respect to the reverse unit 9. The third path is provided with the discharge unit 12 at the downstream end thereof.

The humidifying unit 20 generates a humidified gas (air) and supplies the humidified gas to a space between the sheet and the print heads 14 of the printing unit 4. Thus, drying of ink in the nozzles of the print heads 14 is suppressed. The humidifying unit 20 may be of an evaporative type, a water spray type, a steam type, or the like. The evaporative type includes a rotary type, which is employed in the embodiment, a permeable membrane type, a drop pervaporation type, a capillary type, and the like. The water spray type includes an ultrasonic type, a centrifugal type, a high-pressure-spray type, a two-fluid-atomization type, and the like. The steam type includes a steam duct type, an electrothermal type, an electrode type, and the like. The humidifying unit 20 is connected to the printing unit 4 with a first duct 21 and to the drying unit 8 with a second duct 22. In the drying unit 8, a highly humid hot gas is generated when the sheet is dried. The gas is introduced into the humidifying unit 20 through the second duct 22, and is utilized as auxiliary energy for the generation of the humidified gas in the humidifying unit 20. The humidified gas generated in the humidifying unit 20 is introduced into the printing unit 4 through the first duct 21. The highly humid hot gas exhausted from the drying unit 8 is not directly emitted to the outside of the apparatus but is utilized as auxiliary energy for the generation of the humidified gas in the humidifying unit 20. Therefore, the energy efficiency of the total system of the apparatus is greatly improved.

The control unit 13 controls the units included in the printing apparatus. The control unit 13 includes a controller, an external interface, and an operation unit 15. The controller includes a central processing unit (CPU), a memory, and various controllers. The user performs input and output operations on the operation unit 15. The operation of the printing apparatus is controlled on the basis of instructions from the controller or a host apparatus 16, such as a host computer, connected to the controller via the external interface. The host apparatus 16 is a source from which image data for causing the printing apparatus to perform printing is supplied.

Figure 2:
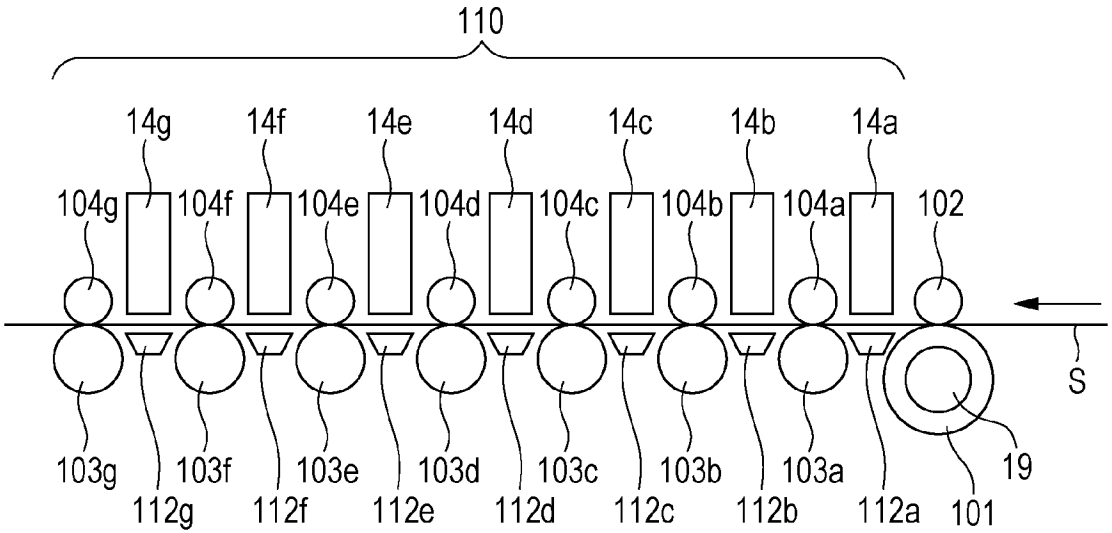
FIG. 2 is a cross-sectional view showing the configuration of a printing unit.

FIG. 2 is a schematic diagram of the printing unit 4. In the printing unit 4, a sheet S is conveyed from right to left in FIG. 2 by two kinds of pairs of rollers: a first pair of rollers and second pairs of rollers. The first pair of rollers include a conveying roller 101 that rotates with a driving force and a pinch roller 102 that rotates following the rotation of the conveying roller 101. The second pairs of rollers include a plurality (seven) of conveying rollers 103*a* to 103*g* that rotates with driving forces and a plurality (seven) of pinch rollers 104*a* to 104*g* that rotate following the rotation of the conveying rollers 103*a* to 103*g*, respectively. The conveying roller 101 is provided with a rotary encoder 19 that detects the state of rotation of the conveying roller 101. Seven line print heads 14*a* to 14*g* provided for different colors are arranged side by side in the conveyance direction in a printing area 110 on the downstream side with respect to the first pair of rollers. The print heads 14*a* to 14*g* and the pinch rollers 104*a* to 104*g* are provided alternately. Platens 112*a* to 112*g* are provided at positions facing the print heads 14*a* to 14*g*, respectively, whereby the sheet S is supported at a correct distance (gap) from each of the nozzles of the print heads 14*a* to 14*g*. The sheet S is nipped by the pairs of rollers provided on the upstream and downstream sides of individual portions thereof facing the respective print heads 14*a* to 14*g*. The foregoing portions of the sheet S are also supported by the respective platens 112*a* to 112*g*. Therefore, the sheet S is conveyed stably.

Referring to FIG. 1, either of the rolls R1 and R2 is selectively used for printing. FIG. 1 shows a case where the roll R1 is being used for printing. While printing is performed in such a state, the user can replace the roll R2 with another roll (the roll R2 can be removed and another roll can be loaded) or a new roll can be loaded as the roll R2. A single roll that is yet to be used weighs as heavy as about five kilograms to several tens of kilograms. When the user desires to load a roll into the sheet feeding unit 1, the user pulls a roll holder from the sheet feeding unit 1, puts the roll onto the roll holder, and pushes the roll holder back into the sheet feeding unit 1. When such a heavy roll weighing five kilograms to several tens of kilograms is put on the roll holder and the roll holder having the roll is pushed into the sheet feeding unit 1, a large impact is applied to the printing apparatus. That is, the sheet feeding unit 1 is a major vibration source of the printing apparatus, and the vibration of the sheet feeding unit 1 can occur whether printing is being performed or not.

Among the units included in the printing apparatus, the printing unit 4 is most susceptible to vibration. As described with reference to FIG. 2, the nozzles of the print heads 14*a* to

14*g* face the surface of the sheet with a distance (gap) therebetween maintained correctly. If the distance changes, the time of flying of ink droplets changes. Consequently, the positions on the sheet at which ink droplets are provided change, and the print quality may be deteriorated. This means that, if a vibration occurring when a roll is loaded into the sheet feeding unit 1 during printing is transmitted to the printing unit 4, the print quality may be adversely influenced.

In the embodiment, to reduce such an adverse influence of vibration, the first housing 41, which is a vibration source, and the second housing 42, which houses the printing unit 4, are separately provided and are individually supported on the floor 40. To block the transmission of vibration more effectively, a gap is provided between the first housing 41 and the second housing 42. The vibration occurring on the first housing 41 when a rolled sheet is loaded is blocked by the gap, and only a slight vibration is transmitted to the second housing 42 through the floor 40. Therefore, the influence on the print quality is negligible. The first housing 41 and the second housing 42 may alternatively be connected with a connecting member. The connecting member, if interposed between the first housing 41 and the second housing 42, is to be made of a material that absorbs vibration. Vibration is absorbed at the connection unless the connection is so firm that the two housings 41 and 42 connected to each other are regarded as a single body. Therefore, compared to a case where the sheet feeding unit and the printing unit are provided in a single housing, the vibration transmitted from the first housing 41 to the second housing 42 is small, and the adverse influence on the print quality is reduced.

Figure 3A:
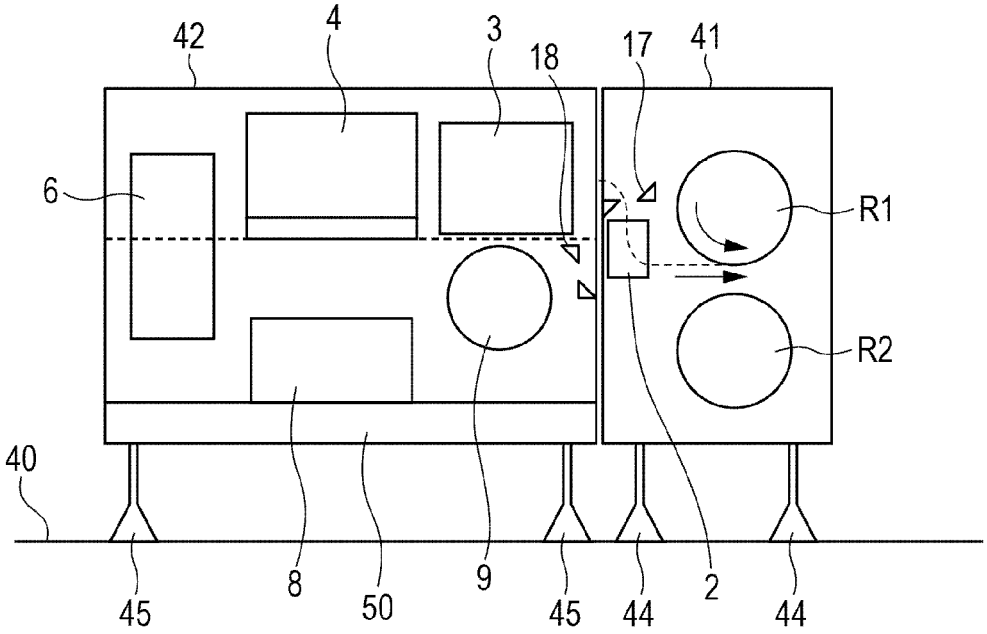
FIGS. 3A and 3B are diagrams for describing a procedure of separating a first housing and a second housing.
Figure 3B:
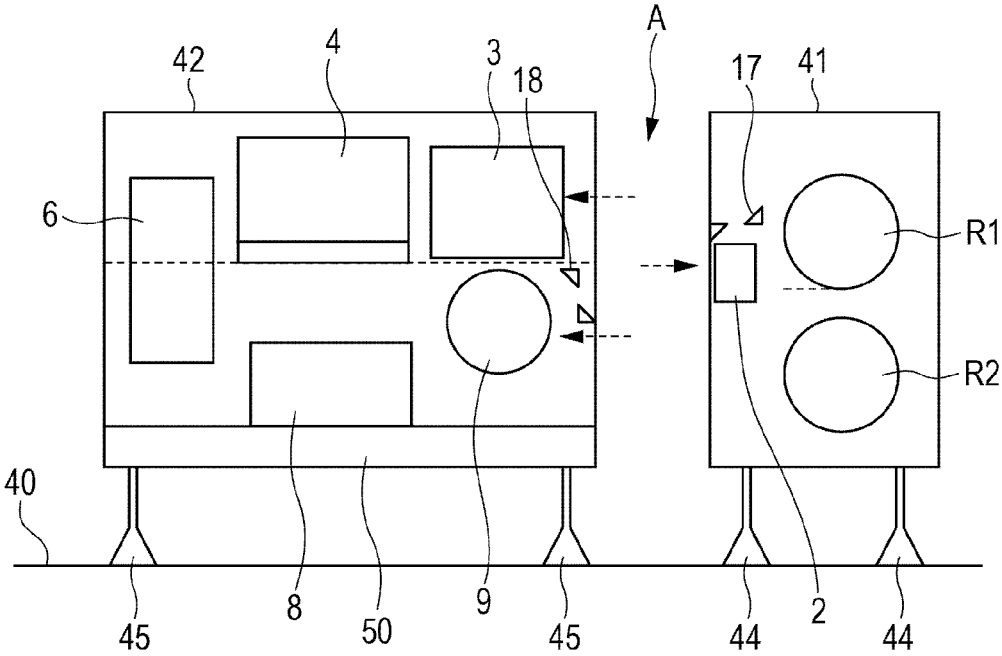

FIGS. 3A and 3B are schematic diagrams for describing a procedure of separating the first housing 41 and the second housing 42. FIG. 3A shows a state before the separation. FIG. 3B shows a state after the separation. To perform maintenance operations such as recovery from a jam occurred during conveyance and replacement of parts, the user moves the first housing 41 from the state shown in FIG. 3A to the state shown in FIG. 3B, whereby a space A is produced. If the continuous sheet extends between the first housing 41 and the second housing 42 at the time of the separation, the sheet is stretched and excessive forces may be applied to relevant units, resulting in a problem that, for example, the sheet is torn. To avoid this, if the first housing 41 and the second housing 42 need to be separated, before the first housing 41 and the second housing 42 are separated, the continuous sheet is rewound into the sheet feeding unit 1 at least such that the end of the sheet does not reside in the space A. In the state shown in FIG. 3A, the continuous sheet is rewound into the roll R1. When the continuous sheet has been rewound such that no portion thereof extends between the first housing 41 and the second housing 42, an indicator of the operation unit 15 notifies the user that the first housing 41 and the second housing 42 are separable. Depending on the position of the occurrence of a jam, the sheet may not easily be rewound into the roll R1. In such a case, the user cuts the sheet with a manual cutter 17, and subsequently separates the first housing 41 from the second housing 42.

Another possibility that the continuous sheet may extend between the first housing 41 and the second housing 42 arises with a jam occurring while the continuous sheet is conveyed from the reverse unit 9 to the decurling unit 2 in back-side printing. In such a case, the reverse unit 9 rewinds the continuous sheet before the first housing 41 is separated from the second housing 42. If the jam prevents the rewinding of the continuous sheet, the user cuts the sheet with a manual cutter 18 and subsequently separates the first housing 41 from the second housing 42. In the path extending between the drying unit 8 and the discharge-conveyance unit 10, no continuous sheet but only cut pieces of the continuous sheet having respective unit images are conveyed. Therefore, the separation of the first housing 41 and the second housing 42 is not hindered by the sheet.

The user can access the position of occurrence of a jam or a unit whose parts need to be replaced from the wide space A shown in FIG. 3B produced by the separation of the housings 41 and 42. Therefore, maintenance operations, such as recovery from a jam and replacement of parts, are performed easily. When the housings 41 and 42 are separated, part of the decurling unit 2, part of the skew correcting unit 3, and part of the reverse unit 9 are exposed. In the units 2, 3, and 9, the continuous sheet is conveyed along a winding path with small curvature radii. Therefore, jams often occur. Accordingly, recovery from a jam needs to be performed frequently. The first housing 41 and the second housing 42 are separated along positions where the continuous sheet is often jammed, and the user accesses such positions in directions indicated by the broken-line arrows shown in FIG. 3B. Therefore, the user can work efficiently. From the viewpoint of maintenance efficiency, all of the decurling unit 2, the skew correcting unit 3, and the reverse unit 9 are to be exposed when the housings 41 and 42 are separated. It is acceptable, however, that at least any of the units 2, 3, and 9 is exposed in the space A.

As described above, since the sheet feeding unit 1 and the printing unit 4 are separately housed in the first housing 41 and the second housing 42, respectively, the transmission of vibration to the printing unit 4 occurring when a continuous sheet is loaded into the sheet feeding unit 1 is suppressed. Therefore, high-quality printing is realized. Furthermore, a sheet to be used subsequently can be loaded into the sheet feeding unit 1 even during printing. Therefore, the total print throughput is increased, and a highly productive printing apparatus is realized. Furthermore, the first housing 41 and the second housing 42 are separable along positions where the continuous sheet is often jammed. Therefore, the user can access the position of occurrence of a jam from the space A (shown in FIG. 3) produced by the separation, and maintenance operations for recovery from the jam can be performed easily.

The configuration in which the first housing 41 and the second housing 42 are separable has a great significance not only in terms of vibration but also in terms of humidity and temperature. For example, the rolls R1 and R2 are rolls of paper and absorb moisture well, particularly on the outermost layers and side faces thereof. Accordingly, the moisture distribution on the entirety of the sheet is uneven. The sheet feeding unit 1 is provided in the first housing 41 that is spatially separated from the second housing 42 in which the humidity is high because of the humidified gas. Therefore, the unevenness in the moisture distribution of the roll standing by in the printing apparatus is reduced. Furthermore, since the control unit 13 is also provided in the first housing 41 in which less heat and moisture are produced than in the second housing 42, the possibility that electronic circuits included in the control unit 13 may cause malfunctions because of heat and/or moisture is reduced.

Figure 4A:
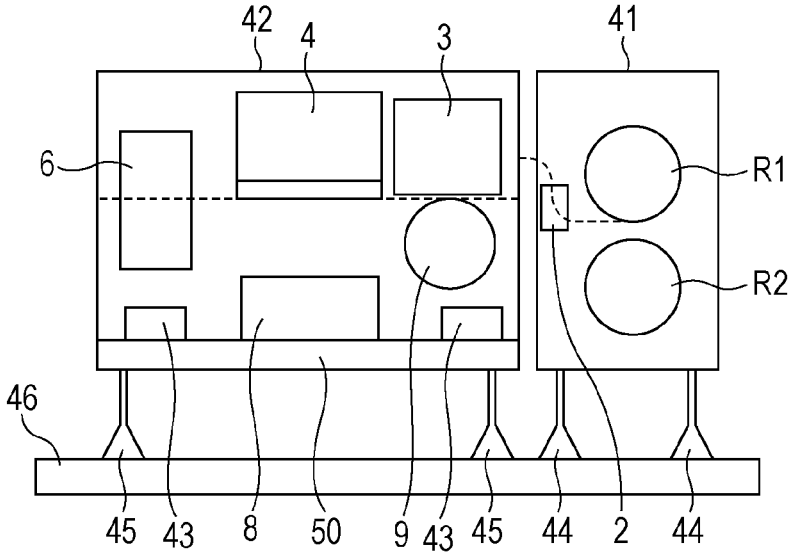
FIGS. 4A, 4B, and 4C are diagrams showing a method of installing the printing apparatus.
Figure 4B:
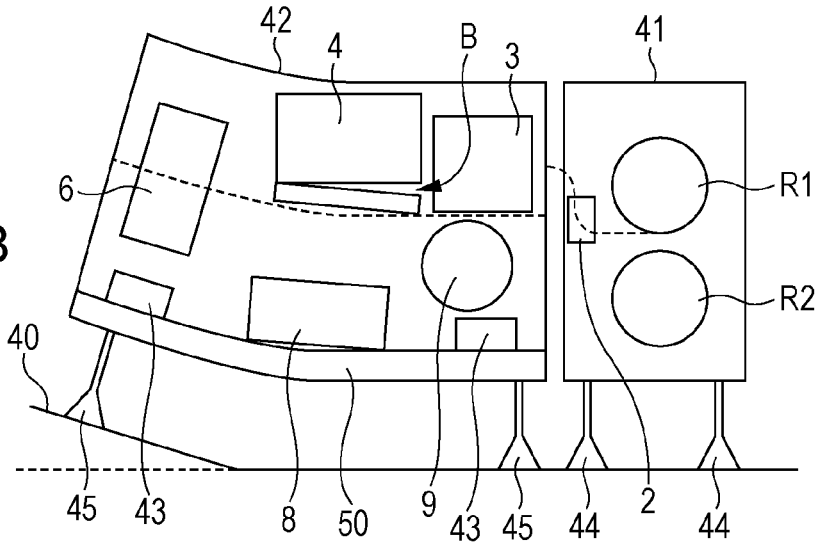
Figure 4C:
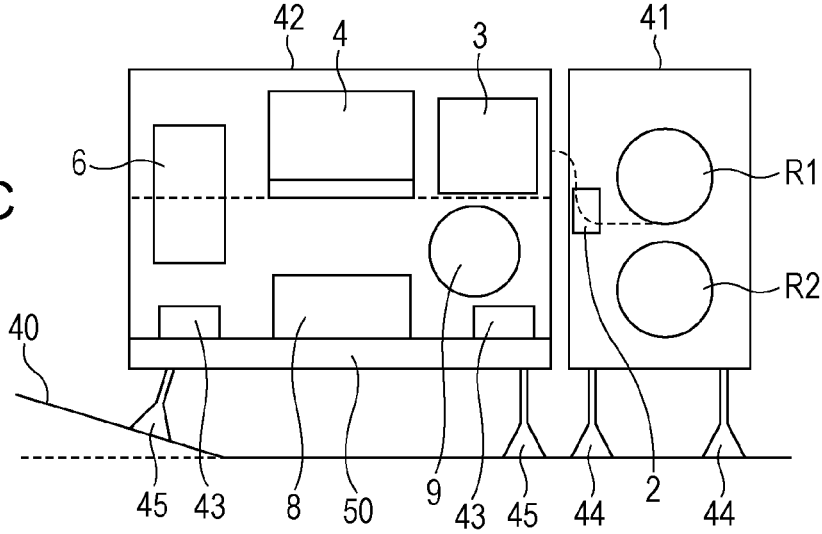

Referring to FIGS. 4A to 4C, a method of installing the printing apparatus performed by the assembling worker will now be described. The relative positional relationship among the units provided in the second housing 42 through which the continuous sheet passes in order need to be maintained precisely. If the original positional relationship changes, the accuracy in conveyance of the sheet may be affected. Hence, when the printing apparatus is assembled in a factory, a base 46 having a precisely level reference surface (a reference installation surface) is prepared and the printing apparatus is installed on that surface so that the second housing 42 is not distorted. A bottom plate 50 of the second housing 42 serves as a base of the second housing 42. The top surface of the bottom plate 50 is adjusted so as to be parallel to the level reference installation surface of the base 46. Specifically, a plurality of levels 43 are placed at distances from one another on the top surface of the bottom plate 50, and the heights of the adjusters provided to the support legs 45 are adjusted such that all of the levels show one specific reading (in the embodiment, level). If all of the levels show the same reading, the top surface of the bottom plate 50 is even and has a high flatness with no bends. Therefore, the second housing 42 maintains the original shape with no distortion. In this state, the units to be housed in the second housing 42 are put into the second housing 42, and the assembly of the printing apparatus is finished. The printing apparatus thus obtained is carried to a user's operating environment.

FIG. 4B shows a state where the printing apparatus is initially installed in a user's operating environment. The distortion shown in FIG. 4B is exaggerated for the convenience of description. In this case, the floor 40 on which the printing apparatus is installed is not flat, with the left side thereof in FIG. 4B (the side of the second housing 42 having the cutter unit 6) being raised. Therefore, the bottom plate 50 is bent with the left side thereof being raised, and the second housing 42 as a whole is distorted with respect to the original shape. Therefore, the relative positional relationship among the printing unit 4, the cutter unit 6, and the drying unit 8 provided in the second housing 42 has changed. In addition, as indicated by arrow B, the body of the printing unit 4, which is required to be particularly precise, is distorted, and the gap between the sheet and the print heads 14 is not constant. If printing is performed in such a state, the resulting print quality is poor.

To avoid this, as shown in FIG. 4C, the heights of the adjusters provided to the support legs 45 are individually adjusted such that all of the levels 43 placed at positions the same as those at the time of assembly, shown in FIG. 4A, show the same reading (level) as that shown at the time of assembly. In this case, the heights of the adjusters provided on the side where the floor 40 is raised are adjusted to be smaller than those in the initial state shown in FIG. 4A. Thus, the bottom plate 50 can have a flatness as high as that in the state shown in FIG. 4A, without being affected by the irregularity of the floor 40. In FIG. 4C, the second housing 42 has the original shape with no distortion, and the positional relationship among the units provided thereinside is the same as that in the initial state shown in FIG. 4A. Furthermore, the printing unit 4 having no distortion can exhibit the original performance. Depending on the user's operating environment, although the floor 40 has a high flatness, the floor 40 as a whole may be inclined. Even in such a case, the printing apparatus can be installed in a level position by adjusting the adjusters as described above. By employing such an installation method, high-quality printing is realized even if the floor on which the printing apparatus is to be installed is not flat.

Figure 5:
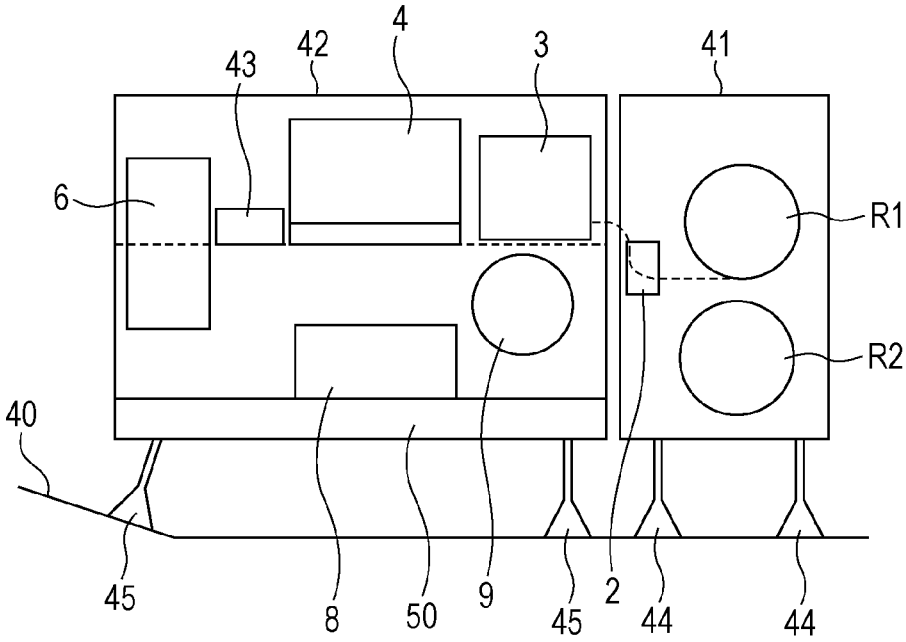
FIG. 5 is a diagram showing an exemplary position at which a level is to be placed.

The reference surface on which the levels 43 are to be placed is not limited to the upper surface of the bottom plate 50, as described in the embodiment, and may be another surface defined in the second housing 42, as shown in FIG. 5. Furthermore, a plurality of levels 43 may not necessarily be provided, but at least one level 43 is to be provided. If the floor 40 of the operating environment is not solid and the state thereof may change gradually with time, adjustment with the levels 43 is to be performed regularly, whereby the normal state can be maintained. After the printing apparatus is installed, the levels 43 are not necessary and may be removed. In such a case, when readjustment is performed, the levels 43 are placed again at the positions and in the directions the same as those at the time of assembly.

Figure 6:
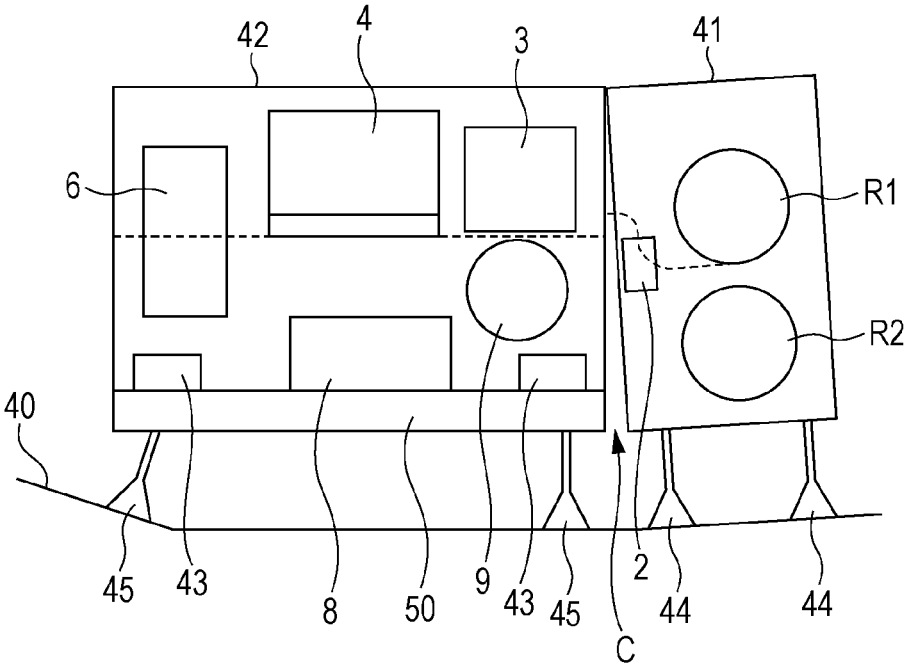
FIG. 6 is a diagram showing a state where the relative positional relationship between the first housing and the second housing has been changed.

While a method of precisely installing the second housing 42 has been described above, the first housing 41 may be installed in the same manner. The units hosed in the first housing 41, however, do not need to be installed so precisely, as compared to the units housed in the second housing 42. Therefore, installation of the first housing 41 may be performed without levels. If the floor 40 on which the first housing 41 is to be installed is inclined as shown in FIG. 6, the first housing 41 is inclined with respect to the second housing 42, and the relative positional relationship between the housings 41 and 42 changes, as indicated by arrow C. The sheet, however, is merely delivered between the first housing 41 and the second housing 42. Moreover, the positional deviation between the housings 41 and 42 is absorbed to some extent by a loop (play) of the continuous sheet formed in the skew correcting unit 3. Therefore, no significant problem occurs.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-108788 filed May 10, 2010, which is hereby incorporated by reference herein in its entirety.

What is claimed is:

1. A printing apparatus comprising:

a sheet feeding unit configured to hold and feed a rolled continuous sheet;

a printing unit configured to perform printing on the continuous sheet fed from the sheet feeding unit;

a first housing, wherein at least the sheet feeding unit is provided in the first housing; and a second housing, wherein at least the printing unit is provided in the second housing, wherein the first housing and the second housing are individually supported on a floor and are separable, and wherein, before the first housing and the second housing are separated, the sheet feeding unit rewinds the continuous sheet that has been fed to the printing unit, thereby an end of the continuous sheet exists in the first housing.

2. The printing apparatus according to claim 1, wherein the first housing and the second housing are provided with a gap interposed between the first housing and the second housing or are connected to each other with a connecting member.

3. The printing apparatus according to claim 1, wherein the sheet feeding unit is configured to hold a plurality of rolled continuous sheets, and wherein, while one continuous sheet is being used for printing, another continuous sheet is loadable into the sheet feeding unit.

4. The printing apparatus according to claim 1, further comprising:

a decurling unit configured to reduce a curl of the continuous sheet fed from the sheet feeding unit; and a skew correcting unit configured to correct a skew of the continuous sheet that is conveyed through the decurling unit and to introduce the skew corrected continuous sheet into the printing unit, wherein, in response to the first housing and the second housing being separated, at least one of part of the decurling unit and part of the skew correcting unit is exposed in a space produced by separating the first and second housings.

5. The printing apparatus according to claim 1, further comprising:

a reverse unit configured to reverse the continuous sheet for duplex printing on the continuous sheet having a plurality of images printed on a first surface thereof and to feed the reversed continuous sheet to the printing unit again, wherein, in response to the first housing and the second housing being separated, part of the reverse unit is exposed in a space produced by separating the first and second housings.

6. The printing apparatus according to claim 5, wherein, while printing on a second surface of the continuous sheet fed from the reverse unit in the duplex printing, another continuous sheet is loadable into the sheet feeding unit.

7. The printing apparatus according to claim 1, further comprising:

a drying unit configured to dry the continuous sheet printed by the printing unit;

a humidifying unit configured to generate a humidified gas; and a duct introducing the humidified gas from the humidifying unit into the printing unit, wherein the drying unit, the humidifying unit, and the duct are provided in the second housing.

8. The printing apparatus according to claim 7, wherein a gas or heat exhausted from the drying unit is utilized when the humidified gas is generated by the humidifying unit.

9. The printing apparatus according to claim 1, further comprising a reverse unit provided in the second housing and configured to wind up the continuous sheet for duplex printing, wherein, before the first housing and the second housing are separated, the reverse unit is winds up the continuous sheet, whereby the continuous sheet is prevented from extending between the first housing and the second housing.

10. The printing apparatus according to claim 1, further comprising a cutter unit provided at least in one of the first housing and the second housing and configured to cut the continuous sheet, wherein, if the continuous sheet is unrewindable, the cutter unit is configured to allow a user to cut the continuous sheet.

11. The printing apparatus according to claim 1, further comprising a control unit configured to control a printing operation and provided in the first housing.

12. A method of installing a printing apparatus, the method comprising:

preparing a base structure having a reference installation surface having a precise horizontal plane;

placing a housing of the printing apparatus on the reference installation surface of the base structure with a plurality of support legs interposed between the housing and the reference installation surface, wherein the support legs include adjusters, respectively, capable of performing height adjustment;

adjusting the adjusters such that each of a plurality of levels placed at a different locations on a reference surface defined in the housing placed on the reference installation surface shows a specific reading;

assembling the printing apparatus by putting a plurality of units including a printing unit into the housing while the housing being placed on the reference installation surface of the base structure;

carrying the assembled printing apparatus while maintaining the height adjustment of the adjusters, then installing the assembled printing apparatus on a floor of an operating environment which is different from the reference installation surface of the base structure; and adjusting, after the printing apparatus being installed on the floor, the adjusters such that each of the levels placed at the locations on the reference surface shows a reading that is same as the specific reading.

13. The method according to claim 12, wherein the housing is a first housing, the method further comprising:

providing a sheet feeding unit, configured to hold a continuous sheet to be fed to the printing unit, in another housing provided separately from the first housing; and supporting the first housing and the another housing individually on the floor.

* * * * *